US006173815B1

(12) United States Patent
Mittermayr

(10) Patent No.: US 6,173,815 B1
(45) Date of Patent: Jan. 16, 2001

(54) DOOR COUPLER AND LOCKING DEVICE

(75) Inventor: Franz Mittermayr, Loich (AT)

(73) Assignee: Kone Corporation, Helsinki (FI)

( * ) Notice: Under 35 U.S.C. 154(b), the term of this patent shall be extended for 0 days.

(21) Appl. No.: 09/141,579

(22) Filed: Aug. 28, 1998

Related U.S. Application Data

(63) Continuation of application No. PCT/FI97/00137, filed on Feb. 28, 1996.

(51) Int. Cl.[7] ..... B66B 13/12

(52) U.S. Cl. ..... 187/330; 187/309; 187/319; 49/120

(58) Field of Search ..... 187/319, 330, 187/331, 335, 307–310; 49/116, 120

(56) References Cited

U.S. PATENT DOCUMENTS

| | | | | |
|---|---|---|---|---|
| 1,326,440 | * | 12/1919 | Chaudoir | 187/330 |
| 2,481,124 | * | 9/1949 | Kruger | 187/319 |
| 3,029,900 | * | 4/1962 | Baker | 187/319 |
| 3,033,317 | * | 5/1962 | Beck et al. | 187/319 |
| 3,065,826 | * | 11/1962 | Tucker, Jr. | 187/319 |
| 3,447,637 | * | 6/1969 | Berkovitz | 187/319 |
| 3,605,952 | * | 9/1971 | Lusti | 187/319 |
| 3,638,762 | * | 2/1972 | Johns | 187/319 |
| 3,783,977 | * | 1/1974 | Voser | 187/319 |
| 3,910,384 | * | 10/1975 | DeFeo | 187/319 |
| 3,912,049 | * | 10/1975 | Holland et al. | 187/330 |
| 4,926,974 | | 5/1990 | Morris et al. | 187/319 |
| 4,926,975 | | 5/1990 | Morris | 187/324 |
| 4,947,964 | * | 8/1990 | Husmann | 187/319 |
| 5,005,673 | * | 4/1991 | Rivera | 187/319 |
| 5,246,089 | * | 9/1993 | Husmann et al. | 187/319 |
| 5,538,106 | * | 7/1996 | McHugh et al. | 187/330 |
| 5,651,427 | * | 7/1997 | Kulak et al. | 187/330 |
| 5,690,189 | * | 11/1997 | Karner | 187/335 |

FOREIGN PATENT DOCUMENTS

| | | | | |
|---|---|---|---|---|
| 1 68663B1 | | 5/1994 | (DK) . | |
| 2-66093 | * | 3/1990 | (JP) | 187/330 |

* cited by examiner

*Primary Examiner*—Robert P. Olszewski
*Assistant Examiner*—Thuy V. Tran
(74) *Attorney, Agent, or Firm*—Birch, Stewart, Kolasch & Birch, LLP

(57) ABSTRACT

A door coupler (4) comprising gripping elements (14,15) moved by a linkage (2) and designed to grip a counterpart (17,18) on the landing door, and a lock catch (10) which has a closed position and an open position. The releasing movement of the lock catch (10) from the closed position into the open position is allowed when a gripping element is pressed against a counterpart.

26 Claims, 2 Drawing Sheets

DOOR COUPLER AND LOCKING DEVICE

This application is a Continuation of prior PCT International Application No. PCT/FI97/00137 which has an International filing date of Feb. 28, 1996 which designated the United States of America, the entire contents of which are hereby incorporated by reference.

BACKGROUND OF THE INVENTION

The present invention relates to a door -coupler and to a locking device for a car door of an elevator.

DESCRIPTION OF THE BACKGROUND ART

In elevators provided with automatic doors, the coupling between the car door and the landing door is generally implemented using a door coupler which is mounted on the car door and which, by means of its gripping elements, engages counterparts mounted on the landing door. The door coupler and the counterparts are so fitted relative to each other that, when the elevator car is moving past the landing door, the counterparts on the landing door pass between the gripping elements of the door coupler. When the car is at a landing and the car doors are moving, the door coupler is in engagement with the counterparts. In this way, the landing door moves together with the car door when the latter is moved by a power means connected to the car door. Often the gripping elements are metal vanes projecting from the door coupler towards the landing door and forming a kind of vertical slot which is open towards the landing door. The counterparts used often consist of rollers mounted on the landing door and projecting from the door towards the elevator shaft, the axle of the rollers being mounted in a position perpendicular to the plane of the door. In conjunction with the door coupler or the car door itself there is a locking device which closes the car door so that it cannot, at least without special measures, be opened except when the elevator car is near a landing, i.e. when the elevator car is within the so-called door zone. The locking system of an elevator door must be reliable and durable. The locking of an elevator door should not produce any disturbing noise.

There are various arrangements for locking the elevator door in a manner that is reliable and suited for use with an elevator door. For instance, a locking system operated by a separate electromechanical actuator requires that the elevator has a separate subsystem or a parallel system for the control of door operation that takes care of locking and unlocking the door. A locking system using a separate electromechanical actuator always involves an additional cost corresponding to the price of the actuator.

There are also mechanical locking systems in which the actuating force for locking the door is taken from the motion of the elevator car or the car door. In such systems the landing zone is indicated and/or the operation of the lock is controlled by means of a separate slide or other sign provided in the elevator shaft at each landing and immovably fixed in place with respect to the elevator shaft. Mounting such slides or signs in the elevator shaft at each landing requires plenty of installation time. A long installation time means high labor costs.

Often the locking arrangement occupies a large space and therefore the placement of the locking devices more or less dictates the design of the door or door suspension of the elevator car.

SUMMARY OF THE INVENTION

To meet the need to achieve a simple, mechanically operated locking device for the door of an elevator car which is applicable for use in a modern elevator environment and in modern elevator technology and is cheap to manufacture and advantageous in respect of space utilization, easy to install, noiseless in operation and is integrated with the door coupler, a new type of door coupler and a new type of locking system are presented as an invention.

The advantages achieved by the invention include the following:

- the locking device is cheap to manufacture.
- being integrated with the door coupler, the locking device permits the application of a simpler door concept. Integrating the door coupler with the locking system simplifies the installation.
- since the locking is controlled by the operation of the door coupler, in other words, by the presence or absence of a counterpart attached to a landing door within the reach of a gripping element of the door coupler, the elevator shaft need not be provided with separate control devices or signs to indicate door zones.
- the locking device is of a construction that does not take up much space, so it is not difficult to accommodate it even in thin structures.
- the locking device is easy to install in conjunction with the door and, being mechanically controlled, requires no electric actuating equipment.
- the door remains locked when outside landing zones, the locking is not affected by possible disturbances in the electrical system of the elevator.
- if in the event of a power failure the elevator has stopped between floors, the door can be opened after the elevator has been moved manually to a landing.
- the equipment does not produce any extra noise when the elevator is running or when the car door is being locked or unlocked.
- the locking and unlocking of the car door of the elevator is dependent on the opening and closing of the door both mechanically and in respect of time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of an example embodiment by referring to the attached drawings which are given by way of illustration only, and thus are not limitative of the present invention, and in which.

DETAILED DESCRIPTION OF THE PREFERRED EMBODIMENTS

In the description, parts are designated by using terms such as left, right, upper, lower, etc. These terms refer to the corresponding directions in the figures, and so do the expressions "clockwise" and "counterclockwise". The use of these directions and terms to explain the invention should not be construed to limit the scope of the claims.

Figure 2:
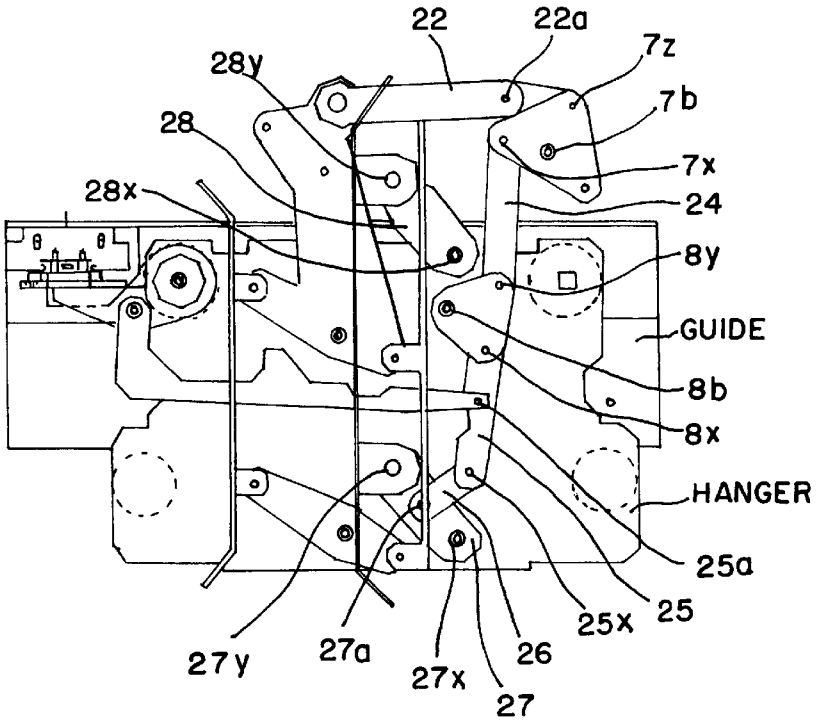
FIGS. 1 and 2 present a door coupler applying the invention together with a locking system when the car is outside the landing zone.
Figure 1:
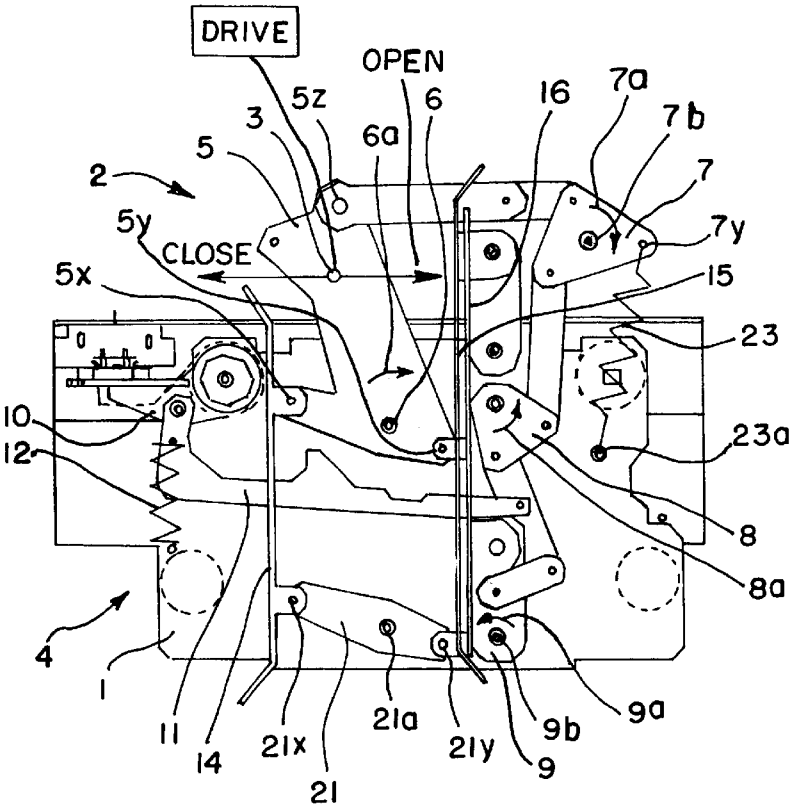
Figure 4:
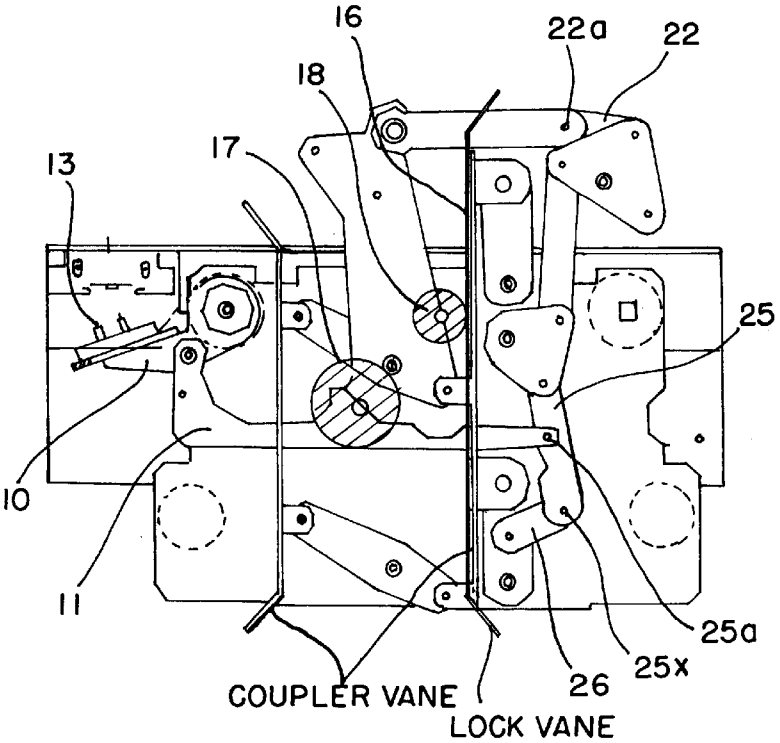
FIGS. 3 and 4 present a door coupler applying the invention together with a locking system when the car is within the landing zone.
Figure 3:
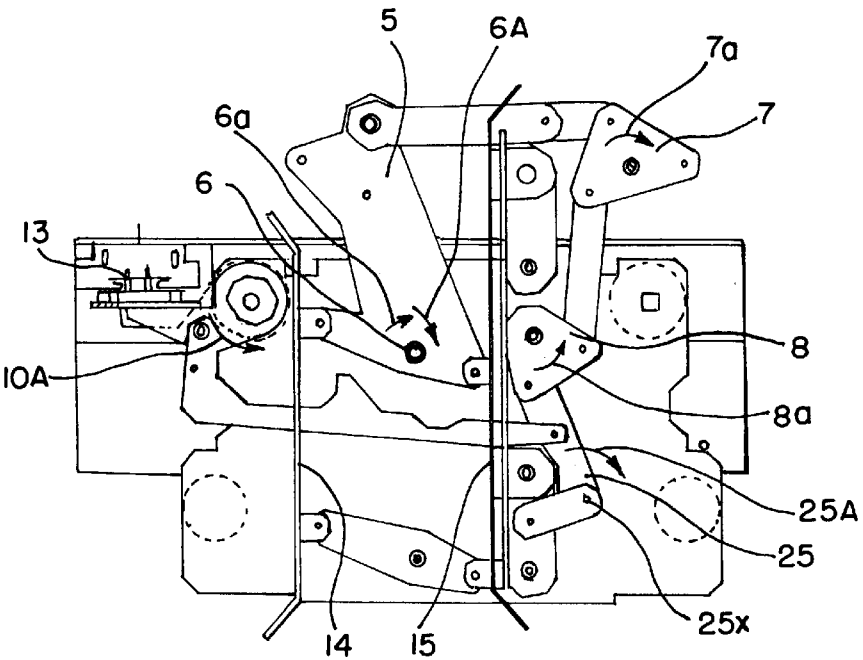

A door coupler 4 with a lock applying the invention and its operation are described by referring to FIGS. 1–4. FIGS. 1 and 2 present a situation where the elevator car is outside the landing zone and the door coupler vanes 14 and 15 cannot meet the rollers constituting the counterparts on the landing doors. FIGS. 3 and 4 present a situation where the elevator car is within the landing zone and the vanes 14,15 engage the rollers 17,18 on the landing door when the doors are opened. The door coupler 4 is mounted on the car door suspension plate 1. The car door suspension plate 1 is provided with supporting rollers and usually also counter rollers, which run along a guide rail or other suitable guide surface on the overhead supporting beam fixed to the elevator car. Thus, supported by the suspension plate(s), the door is suspended from the overhead supporting beam.

The door coupler vanes 14 and 15, between which the rollers 17 and 18 (shown in FIG. 4) attached to the landing door will go when the door coupler engages the landing door, are attached to a linkage system 2 actuated by the car door drive. Connected to the linkage 2 is also a lock catch 10 that locks the car door. The lock catch engages a detent immovable relative to the car door, mounted e.g. on the overhead beam supporting the door, or possibly a door panel moving in the opposite direction. The car door actuator opens and closes the car door. It also opens and closes the landing door, which is coupled to the car door via the door coupler. The car door actuator is e.g. a rope drive acting in the directions of the opening and closing movements of the door and attached to the door coupler 4. Instead of a rope drive, the door actuator may be some other type of drive means, such as a hydraulic cylinder, that produces a driving force acting in the direction of the car door movement. The doors are actually moved by means of the door coupler. The rope drive is connected to the linkage 2 via connection point 3 on the operating lever 5 as indicated by box 100. Due to the action of the rope drive, the operating lever 5 tends to turn, within the limits of its range of motion, in the direction of the rope pull about its pivot 6, which is immovable in relation to the door coupler 4 (and to the suspension plate 1 supporting the door coupler). The operating lever 5 is connected to the suspension plate 1 via pivot 6, permitting a turning movement. The motion of the operating lever 5 about its pivot 6 produces via the linkage 2 an appropriate movement of both the lock catch 10 and the vanes 14 and 15. The movement appropriate in each case depends on whether the elevator is within a door zone or not. The information as to whether the elevator is within a door zone is obtained on the basis of the presence of landing door rollers in the gap between the vanes 14 and 15. Therefore, the height of the gap between the vanes 14 and 15 must be substantially equal to the height of the door zone.

FIG. 1 shows close and open arrows which start from the connection point 3. The close arrow indicates the direction (to the left in the figure) in which the rope drive pulls the door when it is being closed, while the open arrow indicates the direction (to the right in the figure) in which the rope drive pulls the door when it is being opened. The close arrow also indicates the direction of the closing movement of the door and the open arrow the direction of its opening movement. In FIG. 1, the angle through which the operating lever 5 turns counterclockwise about pivot 6 when the rope drive is trying to open the door is indicated by a sector 6*a* depicted at pivot 6. The turning movement of some other parts 7,8,9 in the linkage caused by the turning of the operating lever 5 is indicated by sectors 7*a*,8*a*,9*a* shown on the appropriate parts. These parts 7,8,9 of the linkage turn about pivots 7*b*,8*b*,9*b* immovable with respect to the door coupler. These pivots 7*b*,8*b*,9*b* that are immovable in relation to the door coupler are indicated in the figures with a filled (blackened) circle. All other pivots and connection points that are immovable with respect to the door coupler are also indicated by filled circles. Pivots and connection points moving with the parts of the linkage are indicated with an empty (white) circle. FIG. 2 shows the positions of the parts of the linkage, the door coupler vanes 14 and 15 and the lock catch 10 in which they have ended up as a result of the action of the linkage 2 caused by the motion of the operating lever.

In the following is a description of how the kinetic effect resulting from the operating lever 5 turning through sector 6*a* is transmitted in the linkage 2. The operating lever 5 is connected to the linkage via three movable pivots 5*x*, 5*y* and 5*z*. Below the operating lever 5 there is a supporting lever 21 which is turnably connected to an immovable pivot 21*a* and which has movable pivots 21*x* and 21*y* on it. The lever arms between pivots 21*a* and 21*x* and between pivots 6 and 5*x*, respectively, are of equal length. Similarly, the lever arms between pivots 21*a* and 21*y* and between pivots 6 and 5*y*, respectively, are of equal length. The left vane 14 is connected to the operating lever 5 and to the supporting lever 21 via pivots 5*x* and 21*x*. Connected to the operating lever 5 and the supporting lever 21 is a synchronizing bar 16 via pivots 5*y* and 21*y* in such manner that pivots 5*x*, 21*x*, 5*y* and 21*y* constitute the corner points of a rhomboid, so that the left vane 14 and the synchronizing bar 16 are parallel to each other, the lever arms between pivots 21*a* and 21*x* and between 6 and 5*x* are parallel to each other and the lever arms between pivots 21*a* and 21*y* and between 6 and 5*y* are parallel to each other. In fact, as far its movements are concerned, the synchronizing bar 16 corresponds to the vane of an ordinary door coupler corresponding to vane 15, and this vane 15, which acts as a slide vane actuating the lock, is a detached surface structure of the synchronizing bar 16 which, when departing from the immediate vicinity of the synchronizing bar 16, prevents the lock catch 10 from being released. Connected to the operating lever 5 at pivot 5*z* is the left end of a first rod 22, which connects the operating lever 5 to an upper triangular lever 7. The rod has between its ends a joint 22*a* that permits bending of the rod. The upper triangular lever 7 is held by an immovable pivot 7*b*. Around this pivot 7*b*, the upper triangular lever has pivots 7*x*,7*z* and a connection point for a draw-spring 23 which move with the triangular lever. Connected to the uppermost pivot 7*z* is the right-hand end of the rod 22. When the rod 22 moves right as the operating lever 5 is turning in the clockwise direction, the triangular lever 7 also turns clockwise. This clockwise turning motion is assisted by the draw-spring 23, which applies a pull at the connection point 7*y* on the right, acting in a downward direction towards the point 23*a* of connection of the draw-spring on the suspension plate. No draw-spring 23 would be needed if the rod had no joint 22*a*. The clockwise rotation of the first triangular lever 7 causes the left-hand pivot 7*x* on the triangular lever 7 to move upwards, thus drawing the right-hand movable pivot 8*y* of a second triangular lever 8 upwards by means of a second rod 24, causing triangular lever 8 to turn counterclockwise about pivot 8*b*, with the result that the left-hand pivot 8*x* moves right. The first end of the second rod 24 is connected to pivot 7*x* and the second end to pivot 8*y*. The pivots 8*b*,8*x*,8*y* of triangular lever 8 are located near the corners of the triangular lever 8.

In fact, the above description of the movements of the various parts of the linkage applies both inside and outside the landing zone and the movements take place in consequence of the operating lever 5 turning through an angle corresponding to sector 6*a* when the door control reference, in other words the pull produced by the door drive, changes from the close direction to the open direction.

Now, referring to FIGS. 1 and 2, a situation will be described where the elevator car is outside the landing zone, and then, referring to FIGS. 3 and 4, a situation where the elevator car is within the landing zone.

Connected by its first end to pivot 8*x* on triangular lever 8 is a third rod 25. Via a pivot 25*a* between its ends, the third rod 25 is turnably attached to the right-hand end of a substantially L-shaped locking lever 11. The locking lever 11 remains substantially stationary, and this is ensured by a compression spring 12 which applies an upward pressure to the left-hand end of the locking lever, which in turn presses the lock catch 10 towards the locked position. The drawings show the springs 12 and 23 only in FIG. 1. As the triangular lever 8 causes the first end of the rod 25 connected to pivot 8*x* to move right, the rod 25 turns about pivot 25*a,* with the result that the second end of the rod moves left and, via a fourth rod 26, applies a force to pivot 27*a* between the ends of the first suspension lever 27 of vane 15, causing said lever 27 to turn left. The first end of the fourth rod 26 is connected via pivot 25*x* to the second end of the third rod 25, while the second end of the fourth rod 26 is connected to pivot 27*a* on the first suspension lever 27. Vane 15 is connected to the door coupler via two suspension levers 27 and 28. The first suspension lever 27 and the second suspension lever 28 are turnably connected to the suspension plate 1 supporting the door coupler via the pivots 27*x* and 28*x* at their first ends, which are immovable in relation to the door coupler. The second ends of the suspension levers 27 and 28 are connected to vane 15 via pivots 27*y*,28*y*. The two suspension levers 27 and 28 are of the same length. Pivots 27*y*, 28*y*, 27*x* and 28*x* are so disposed relative to each other and to the suspension plate 1 that, when the suspension levers 27,28 are turning, vane 15 remains aligned in a vertical direction. Thus, the motion of the linkage will not release the lock when the car is outside the landing zone, but merely causes vane 15 to move to the left. The compression spring 12 ensures that the vane will move to the left. Due to the force applied by the compression spring to the locking lever 11, pivot 25*a* remains stationary while pivot 25*x* is moving.

Referring to FIGS. 3 and 4, a situation is now described where the elevator car is in a landing zone and the locking of the car door is released.

FIG. 3 shows a sector 6*a* at pivot 6 to indicate the angle through which the operating lever 5 first turns in the counterclockwise direction to release the lock, and another sector 6A through which the operating lever 5 subsequently turns to permit the door coupler 4 to engage the rollers 17,18 on the landing door.

In the manner described above, the action of the linkage produces, among other things, turning movements of the triangular levers 7 and 8, as indicated by the sectors 7*a* and 8*a* depicted on top of said levers. Since the right-hand vane 15, when the elevator car is within the landing zone, is pressed against the right-hand roller 18, some of the various parts of the linkage move in a different way than when the car is outside the landing zone as stated above. Roller 18 is, so to speak, a fixed roller, in other words, it is the one of the rollers that remains substantially immovable in the horizontal direction relative to the landing door when the door coupler vane is pressed against it. On the other hand, roller 17 can move through some distance relative to the landing door, so the movement produced by the pressure applied to this roller by door coupler vane 14 can be used to release the lock of the landing door. As vane 15 is pressed against roller 18, this prevents it from moving to the left. An important movement in respect of the desired operation is the clockwise turning movement of the third rod 25 about pivot 25*x* through an angle indicated by sector 25A that takes place as a result of the counterclockwise rotation of triangular lever 8.

FIG. 4 shows the positions of the parts of the linkage 2, the door coupler vanes 14 and 15 and the lock catch 10 in which they have ended up as a result of the action of the linkage caused by the operating lever moving through an angle corresponding to sector 6*a*. Connected to pivot 8*x* on triangular lever 8 is the first end of rod 25, whose lower end is connected to the fourth rod, and the pivot 25*x* at its end acts as the fulcrum of its turning movement when its upper end is moved to the right by the triangular lever. Since the movement of the right-hand vane 15 and therefore also the movement of suspension lever 27 is prevented, the pivot 25*x* at the right-hand end of the fourth rod acts as a substantially immovable fulcrum for the turning movement of the third rod 25. In this situation, the effect of the compression spring 12 on lever 11 is outbalanced by the supporting force indirectly received by pivot 25*x*. Consequently, the pivot between the ends of the third rod to which the L-shaped locking lever 11 is connected is drawn through a certain distance to the right. The pull resulting from the movement of the locking lever 11 releases the lock catch 10, thus permitting the opening movement of the car door to be started. At the same time, a safety switch 13 provided in conjunction with the lock catch 10 is opened. From the safety switch, an electric signal indicating whether the car door is locked or not is supplied to the safety circuit and, if necessary, to the control system of the elevator. After the lock has been released, the operating lever will turn further through a distance corresponding to sector 6A as shown in FIG. 3. This movement of the operating lever causes the right-hand door coupler vane 14 to move into contact with the right-hand roller 17 on the landing door and finally the door coupler rollers 17,18 to be pressed between the door coupler vanes 14,15, resulting in complete coupling between the landing door and the car door. The operating lever is free to turn through sector 6A because lever 22 is provided with a joint 22*a* that permits the rod to bend so that its motion towards triangular lever 7 after the release of the lock is substantially completely received by the bending of the rod 22.

It is obvious to a person skilled in the art that different embodiments of the invention are not limited to the examples described above, but that they can be varied within the scope of the claims presented below.

What is claimed is:

1. A door coupler for a car door of an elevator, the door coupler comprising:

a plurality of gripping elements;

at least one counter provided on a landing door;

a linkage for moving the gripping elements in order to engage at least one of the gripping elements with at least one of the counters on the landing door;

a lock catch movable between an open and closed position, the lock catch prevents movement of the car door when in the closed position and permits movement of the car door when in the open position, the lock catch being moved from the closed position to an open position when the at least one gripping element engages the at least one counter to enable opening movement of the car door, the lock catch being moved from the closed position before the landing door and the car door begins to move and the lock catch being moved by the linkage; and a drive for moving the doors, the at least one gripping element being moved into engagement with the at least one counter by the drive for moving the doors.

2. The door coupler as defined in claim 1, further comprising a spring connected directly to the lock catch, the spring urges said lock catch to the closed position.

3. The door coupler as defined in claim 1, further comprising a spring acting on the lock catch, the spring urges said lock catch to the closed position.

4. The door coupler as defined in claim 1, wherein the elevator has an elevator car and wherein the drive is on the elevator car.

5. The door coupler as defined in claim 4, wherein a single drive motor is provided for the drive.

6. The door coupler as defined in claim 1, wherein a single drive motor is provided for the drive.

7. The door coupler as defined in claim 1, wherein the lock catch is a mechanical control whereby a solely electric control for holding the car door in the closed position is avoided.

8. The door coupler as defined in claim 1, wherein the linkage includes an operating lever connected to the drive, the operating lever moving the gripping elements so that at least one of the gripping elements engages the at least one counter.

9. The door coupler as defined in claim 8, wherein when the operating lever moves the at least one gripping element to engage the at least one counter, the lock catch is moved to the open position; and when the operating lever is moved by the drive and the at least one gripping element fails to engage the at least one counter, the lock catch remains in the closed position.

10. The door coupler as defined in claim 9, wherein the gripping elements includes at least two vertical vanes with a gap therebetween, the at least one counter being movable in the gap between the at least two vanes.

11. The door coupler as defined in claim 10, wherein the at least two vertical vanes are opened toward the landing door and are each bent outwardly at upper and lower ends thereof away from the gap.

12. The door coupler as defined in claim 11, wherein the at least one counter includes a roller projecting from the landing door towards a shaft of the elevator, the roller being aligned with the gap between the at least two vanes.

13. The door coupler as defined in claim 12, wherein two vanes are provided as the gripping elements and wherein two rollers are provided as the at least one counter.

14. The door coupler as defined in claim 1, wherein the gripping elements includes at least two vertical vanes with a gap therebetween, the at least one counter being movable in the gap between the at least two vanes.

15. The door coupler as defined in claim 14, wherein the at least two vertical vanes are opened toward the landing door and are each bent outwardly at upper and lower ends thereof away from the gap.

16. The door coupler as defined in claim 15, wherein the at least one counter includes a roller projecting from the landing door towards a shaft of the elevator, the roller being aligned with the gap between the at least two vanes.

17. The door coupler as defined in claim 16, wherein two vanes are provided as the gripping elements and wherein two rollers are provided as the at least one counter.

18. The door coupler as defined in claim 1, further comprising a spring acting on the lock catch, the spring urges said lock catch to the closed position and wherein the linkage includes an operating lever connected to the drive.

19. The door coupler as defined in claim 18, wherein the linkage includes a rod to which the lock catch is pivotably mounted at a pivot, a force produced at the pivot by the spring tending to hold the pivot in place being smaller than an opposite force produced by movement of the linkage when the operating lever is turning in an opening direction and when the at least one gripping element simultaneously engages the at least one counter.

20. The door coupler as defined in claim 1, wherein the linkage includes a rod to which the lock catch is pivotably mounted at a pivot.

21. The door coupler as defined in claim 1, wherein the linkage includes an operating lever connected to the drive, a first rod connected to the operating lever, a first lever connected to the first rod, a second rod connected to the first lever, a second lever connected to the second rod, and a third rod connected to the second lever, and wherein the lock catch includes a locking lever connected to the third rod.

22. The door coupler as defined in claim 21, wherein the connections of the linkage are pivotable connections and wherein the locking lever is pivotably connected to the third rod.

23. The door coupler as defined in claim 21, wherein the first and second levers are triangular levers, corners of the first lever being connected to the first rod, the second rod and to a draw-spring, and corners of the second lever being connected to the second rod, the third rod and a pivot point.

24. The door coupler as defined in claim 1, further comprising a synchronizing bar and a supporting lever, and wherein the linkage includes an operating lever connected to the drive, the operating lever extending between at least one of the gripping elements the synchronizing bar, the supporting lever also extends between the at least one of the gripping elements and the synchronizing bar, the synchronizing bar being connected to another of the gripping elements through suspension levers.

25. The door coupler as defined in claim 24, wherein the linkage further includes a first rod connected to the operating lever, a first lever connected to the first rod, a second rod connected to the first lever, a second lever connected to the second rod, and a third rod connected to the second lever, and wherein the lock catch includes a locking lever connected to the third rod and wherein the third rod is connected to one of the suspension levers by a fourth rod.

26. The door coupler as defined in claim 25, wherein the another of the gripping elements is movable into engagement with the at least one counter upon movement of the operating lever by the drive.

* * * * *

UNITED STATES PATENT AND TRADEMARK OFFICE

CERTIFICATE OF CORRECTION

PATENT NO. : 6,173,815 B1
DATED : January 16, 2001
INVENTOR(S) : Franz Mittermayr It is certified that error appears in the above-identified patent and that said Letters Patent is hereby corrected as shown below:

Column 6,
Line 57, change “counter” to -- counterpart --
Line 60, change “counters” to -- counterparts --

Column 7,
Lines 1, 8, 30, 33, 37, 41, 48, 53 and 56, change “counter” to -- counterpart --

Column 8,
Lines 2, 7, 19 and 59, change “counter” to -- counterpart --

Signed and Sealed this

Third Day of June, 2003

JAMES E. ROGAN
*Director of the United States Patent and Trademark Office*